US007495619B2

(12) United States Patent
Fossett

(10) Patent No.: US 7,495,619 B2
(45) Date of Patent: Feb. 24, 2009

(54) SYSTEMS AND METHODS THAT UTILIZE AN ACTIVE STUB/PARASITIC WHIP ANTENNA TO FACILITATE MOBILE COMMUNICATION

(75) Inventor: Larry Fossett, Ramona, CA (US)

(73) Assignee: Nokia Corporation, Epsoo (FI)

( * ) Notice: Subject to any disclaimer, the term of this patent is extended or adjusted under 35 U.S.C. 154(b) by 0 days.

(21) Appl. No.: 10/588,670

(22) PCT Filed: Feb. 18, 2005

(86) PCT No.: PCT/IB2005/000415

§ 371 (c)(1),
(2), (4) Date: Aug. 7, 2006

(87) PCT Pub. No.: WO2005/079148

PCT Pub. Date: Sep. 1, 2005

(65) Prior Publication Data

US 2007/0159402 A1 Jul. 12, 2007

(51) Int. Cl.
*H01Q 1/24* (2006.01)
*H01Q 1/10* (2006.01)

(52) U.S. Cl. ..... 343/702; 343/900; 343/901; 343/895

(58) Field of Classification Search ..... 343/702, 343/900, 901, 895
See application file for complete search history.

(56) References Cited

U.S. PATENT DOCUMENTS

| | | | | |
|---|---|---|---|---|
| 5,955,050 | A * | 9/1999 | Drexler | 423/531 |
| 5,969,684 | A * | 10/1999 | Oh et al. | 343/702 |
| 6,069,592 | A * | 5/2000 | Wass | 343/895 |
| 6,239,755 | B1 * | 5/2001 | Klemens et al. | 343/702 |
| 6,642,893 | B1 | 11/2003 | Hebron et al. | 343/702 |

FOREIGN PATENT DOCUMENTS

EP 1 122 811 A1 8/2001

* cited by examiner

*Primary Examiner*—Hoang V Nguyen
(74) *Attorney, Agent, or Firm*—Harrington & Smith, PC

(57) ABSTRACT

The present invention provides systems and methods that facilitate transmission and/or reception of radio frequency (RF) signals within a mobile communications device. The systems and methods include a first antenna component such as an active stub that comprises one or more active elements and a second antenna component such as a parasitic whip that is electromagnetically coupled to the first antenna component. The systems and methods provide a relatively compact antenna structure for mobile devices with limited physical volume, or footprint. The antenna structure does not require a mechanical interface (e.g., a galvanic connection) between the active stub and parasitic whip to provide a conductive connection to the whip when it is in an extended position. The novel systems and methods yield reduced antenna wear, higher antenna gain and better radiation efficiency than conventional systems and do not require a matching circuit to achieve multi-band resonances.

31 Claims, 12 Drawing Sheets

SYSTEMS AND METHODS THAT UTILIZE AN ACTIVE STUB/PARASITIC WHIP ANTENNA TO FACILITATE MOBILE COMMUNICATION

TECHNICAL FIELD

The present invention generally relates to mobile communication. More particularly, the present invention relates to employing an antenna structure that utilizes an active stub and a parasitic whip as a radiator within a mobile communications device.

BACKGROUND OF THE INVENTION

Early mobile communication devices employed analog radio transmission such as Advanced Mobile Phone System (AMPS), for example. Such analog technologies were sufficient for an emerging mobile communications consumer market. However, within a relatively short period of time, millions of new mobile communications subscribers, demanding more and more airtime, pushed the existing analog technology to a capacity limit or ceiling. As a consequence, dropped calls and busy signals became common, which fueled a demand for an improved mobile communication network.

In response to the demand, industry developed digital wireless technologies that could accommodate the increased network traffic within a limited amount of radio spectrum. For example, technologies such as Global System for Mobile (GSM) employing Time Division Multiple Access (TDMA) were developed, wherein a time-sharing protocol was employed to provide three to four times more capacity than the existing analog technologies. In general, TDMA employs a technique wherein a communication channel is divided into sequential time slices. Each user of a channel is provided with a time slice for transmitting and receiving information in a round-robin manner. For example, at any given time "t," a user is provided access to the channel for a short burst. Then, access switches to another user who is provided with a short burst of time for transmitting and receiving information. The cycle of "taking turns" continues, and eventually each user is provided with multiple transmission and reception bursts.

Shortly after TDMA was introduced, Code Division Multiple Access (CDMA) was developed, and represented an enhanced solution to the analog transmission deficiencies. Code Division Multiple Access provides for "true" sharing, wherein one or more users can transmit and receive concurrently. Code Division Multiple Access provides sharing via employing spread spectrum digital modulation, wherein a user's stream of bits is encoded and spread across a very wide channel in a pseudo-random fashion. The receiver is designed to recognize and undo the randomization in order to collect the bits for a particular user in a coherent manner. Code Division Multiple Access provides approximately ten times the capacity of the analog technologies, and enables increased voice quality, broader coverage and increased security. Today, CDMA is one of the prevalent technologies employed in mobile systems.

Technological advances in the electronics and computer industries, including smaller components, reduced power consumption, and the Internet, for example, have driven the mobile communications industry to further GSM and CDMA technologies, and to explore other technologies. One such improvement includes EDGE (Enhanced Data-Rates for Global Evolution) technology. The evolution of GSM to EDGE mitigates various issues associated with voice traffic bandwidth and provides higher data throughput, affording for more efficiency and higher performance. For example, EDGE provides for data rates up to 384 Kbps (with a bit-rate up to 69.2 Kbps per timeslot) over broadband. In addition, EDGE provides for more robust services such as Short Message Service (SMS) and Multimedia Message Service (MMS) for messaging, XHTML (including WAP) browsing, Java applications, FM radio reception, video streaming, and voice and image recording technologies.

Another result of continued efforts to improve mobile communications includes the International Telecommunications Union's adoption of an industry standard for third-generation (3G) wireless systems that can provide high-speed data rates (e.g., for data transmission and Internet use) and new features. Currently, three operating modes (CDMA2000, WCDMA and TD-SCDMA) based on CDMA technology are being developed. CDMA2000 technology provides a relatively simple, quick, and cost-effective path to 3G service. CDMA2000 1x technology supports voice and data services over a standard IS-95 CDMA channel. Additionally, it provides up to twice the capacity (e.g., peak data rates up to 153 kbps and projected peak data rates up to 307 kbps, without compromising voice capacity) of the earlier CDMA networks. The additional capacity accommodates the continuing growth in the wireless Internet market. Moreover, CDMA2000 1x provides longer standby times and is backwards compatible. CDMA2000 1x EV-DO technology provides a data optimized version of CDMA2000 with peak data rates over 2 Mbps and an average throughput of over 700 kbps, which is comparable to DSL and can support video streaming and large file downloads. CDMA2000 1x EV-DV technology is an enhanced version of CDMA 1x that facilitates improved performance in connection with data and voice transmissions within a wireless network. WCDMA and TD-SCDMA represent more complex enhancements that can entail more costly and complex components, new network designs, and longer verification and validation periods.

Current technologies within the global mobile communication community include cellular, Personal Communication Service (PCS) and Global Positioning System (GPS), for example. Cellular communication is typically associated with frequencies around 800 MHz. Personal Communication Service is typically associated with frequencies around 1900 MHz. Global Positioning System is typically associated with frequencies around 1600 MHz.

As mobile communications transmission evolves, the electrical and software industries are concurrently developing mobile devices that are smaller, consume less power, cost less and include more applications. One obstacle confronted by mobile device designers is the need to provide more reliable, easier to manufacture, and lower cost antennas for smaller mobile devices, which have limited physical volumes or a limited footprint for antennas. Such devices can be, for example, fold phones.

SUMMARY OF THE INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The present invention facilitates transmission and/or reception of radio frequency (RF) signals via mobile communications devices (e.g., cellular telephone). The systems and methods provide a relatively compact antenna for mobile communication devices with limited physical volume, or footprint. The present invention employs a simple antenna design that reduces antenna wear, which can be more reliable, easier to manufacture and can reduce cost. Additionally, the present invention can yield higher antenna gain and better radiation efficiency than conventional systems and does not require a matching circuit to achieve multi-band resonances. Furthermore, the present invention is adaptable to be incorporated into virtually any wireless communication device.

The present invention contemplates a mobile communication device with two or more antenna components, wherein the first antenna component (e.g., transceiving component) is coupled to the mobile communication device and the second antenna component (e.g., extendable component) is employed without a galvanic connection to the first antenna component. For example, in accordance with an aspect of the present invention, the first antenna component can be an active stub and the second antenna component can be a parasitic whip. The first antenna component can be tuned to be operable at one or more frequency bands associated with disparate communication types (e.g., cellular (~800 MHz), PCS (1.91-1.99 GHz), GPS (1.575 GHz), . . . ). It is to be understood, however, that the present invention contemplates utilization of any communication type. The first antenna component (e.g., active stub) can be comprised of one or more conductive elements. According to an aspect of the present invention, the first antenna component comprises meander line elements. Another aspect contemplates utilization of one or more helical elements.

The second antenna component, although lacking a galvanic connection to the first antenna component, is electromagnetically coupled to the first antenna component and is operable to resonant at frequencies close to the resonant frequencies associated with the first antenna component. The second antenna component can be, for example, a parasitic quarter-wave whip, a parasitic three-eighths wave whip, a parasitic five-eights wave whip, etc. Additionally, the second antenna component can be retractable such that when retracted, the second antenna component is de-coupled from and does not alter performance of the first antenna component. The second antenna component is tuned by altering its electrical length and/or changing the amount of overlap between the first antenna component and the second antenna component. For example, an aspect of the present invention contemplates the length of the parasitic whip to be 60-120 mm, and further employs positioning the parasitic whip between and substantially parallel to meander line elements of the active stub so that there is 4-6 mm of overlap between the two components.

In accordance with another aspect of the present invention, when the second antenna component (e.g., parasitic whip) is retracted, it is detuned from the first antenna component (e.g., active stub). Detuning can be accomplished by employing a detuning circuit (e.g., matching network) or by utilizing a non-conductive end affixed to the end of the parasitic whip to prevent overlapping of the two antenna components.

In accordance with another aspect of the present invention, methods are provided which utilize an active stub and a parasitic whip to facilitate reception and/or transmission of radio frequency (RF) signals.

To the accomplishment of the foregoing and related ends, certain illustrative aspects of the invention are described herein in connection with the following description and the annexed drawings. These aspects are indicative, however, of but a few of the various ways in which the principles of the invention may be employed, and the present invention is intended to include all such aspects and their equivalents. Other advantages and novel features of the invention may become apparent from the following detailed description of the invention when considered in conjunction with the drawings.

DETAILED DESCRIPTION OF THE INVENTION

Figure 1:
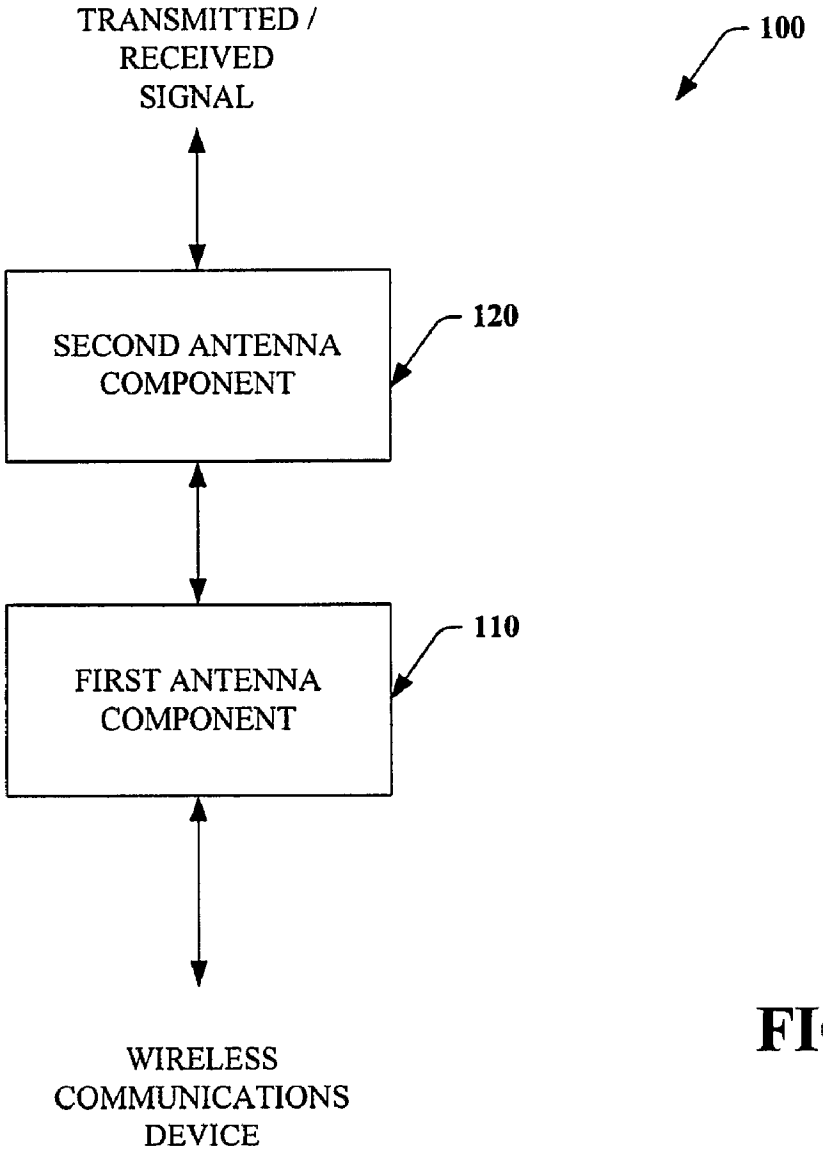
FIG. 1 is a block diagram of a system that facilitates mobile communications in accordance with an aspect of the present invention.

The present invention relates to systems and methods that transmit and/or receive radio frequency (RF) signals via mobile communication devices (e.g. a cellular phone). In particular, the systems and methods provide a relatively compact antenna structure for mobile devices with limited physical volume (e.g., footprint), wherein the antenna structure can include an active stub and a parasitic whip. The antenna structure of the present invention does not require a mechanical interface between the active stub and parasitic whip to provide a conductive connection to the whip when it is in an extended position. Since the mechanical interface is not employed, the present invention provides a simple antenna design, which reduces antenna wear, is more reliable, easier to manufacture, and reduces cost.

The present invention is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

Referring now to FIG. 1, a system 100 that enables a wireless communication device to transmit and/or receive signals is illustrated. The system comprises a first antenna component (e.g., transceiving component) 110 and a second antenna component (e.g., extendable component) 120. The first antenna component 110 can be coupled to the wireless communications device, and additionally can be physically located outside of the housing of the wireless communications device. The first antenna component 110 obtains a signal (e.g., modulated signal) to transmit from the wireless communication device and provides a received signal to the wireless communication device. In one aspect of the present invention, the first antenna component 110 can be either an active or parasitic antenna. According to another aspect of the present invention, the first antenna component 110 can be a stub antenna, although it is to be appreciated that alternative antenna designs can be utilized in implementing the present invention.

Moreover, it is contemplated that the first antenna component 110 can be a single band antenna, a dual band antenna, a multi-band antenna, etc. The first antenna component 110 can be tuned to transmit and receive one or more signals at frequencies associated with, for example, cellular communications signals (~800 MHz), PCS signals (1.91-1.99 GHz), GPS signals (1.575 GHz), Korean PCS signals (~1700 MHz), China PCS signals (~2100 MHz), etc. The first antenna component 110 can be made of any conducting material that can carry a pulsing or alternating current. The wireless communications device can be, for example, a cellular phone, a PDA, a handheld computer, a laptop computer, a pager etc.

According to one aspect of the present invention, the first antenna component 110 can comprise a helical conductive element, where helical lines are printed on a non-conductive substrate. For a helical antenna element, resonant frequency is based on material used, cross-sectional area of the conductor, cross-sectional area of the coil, number of turns, and spacing between each turn of the coil. By way of example, the coil can be made of a copper conductor. One or more helical conductors can be printed within the first antenna component 110, each radiator associated with a particular frequency range for a communications technique (e.g., cellular communications, PCS, GPS, Korean PCS, China PCS, . . . ). According to another aspect of the present invention, the first antenna component 110 can comprise a meander line conductive element. One or more meander lines can be printed along the side of the non-conductive substrate.

The first antenna component 110 interfaces with the second antenna component 120 (e.g., via a non-galvanic interface). The second antenna component 120 is a parasitic antenna element. No galvanic connection is required between the first antenna component 110 and the second antenna component 120. For example, the second antenna component 120 can be a quarter wavelength whip antenna, a three-eighths wavelength whip antenna, a five-eighths wavelength whip antenna, etc., although alternative antenna designs are contemplated. The second antenna component 120 is utilized to enhance the radiation of the first antenna component 110. The second antenna component 120 facilitates reception and transmission of radio frequency signals to and from wireless communications device.

The system 100 provides numerous advantages over conventional systems. For example, utilization of the second antenna component 120 enhances radiation (e.g., widens bandwidth, . . . ) of the first antenna component 110. Furthermore, the system 100 eliminates the need for a mechanical interface between the first antenna component 110 and the second antenna component 120. Since the mechanical interface is not required, the design of the system 100 can employ fewer parts compared to traditional systems. Consequently, the system 100 is more reliable, easier to manufacture, and costs less.

Additional benefits can include higher antenna gain, and adaptability of the design to many wireless communications devices. Furthermore, tuning of the present invention is simpler than conventional techniques since the second antenna component 120, which is a parasitic antenna, does not need to be tuned. The second antenna component 120 resonates at frequencies close to the resonant frequency(s) associated with the first antenna component 110. Thus, only the first antenna component 110 requires tuning. Furthermore, matching circuit design is not required to achieve multiband resonances for both the first antenna component 110 and the second antenna component 120.

Figure 2:
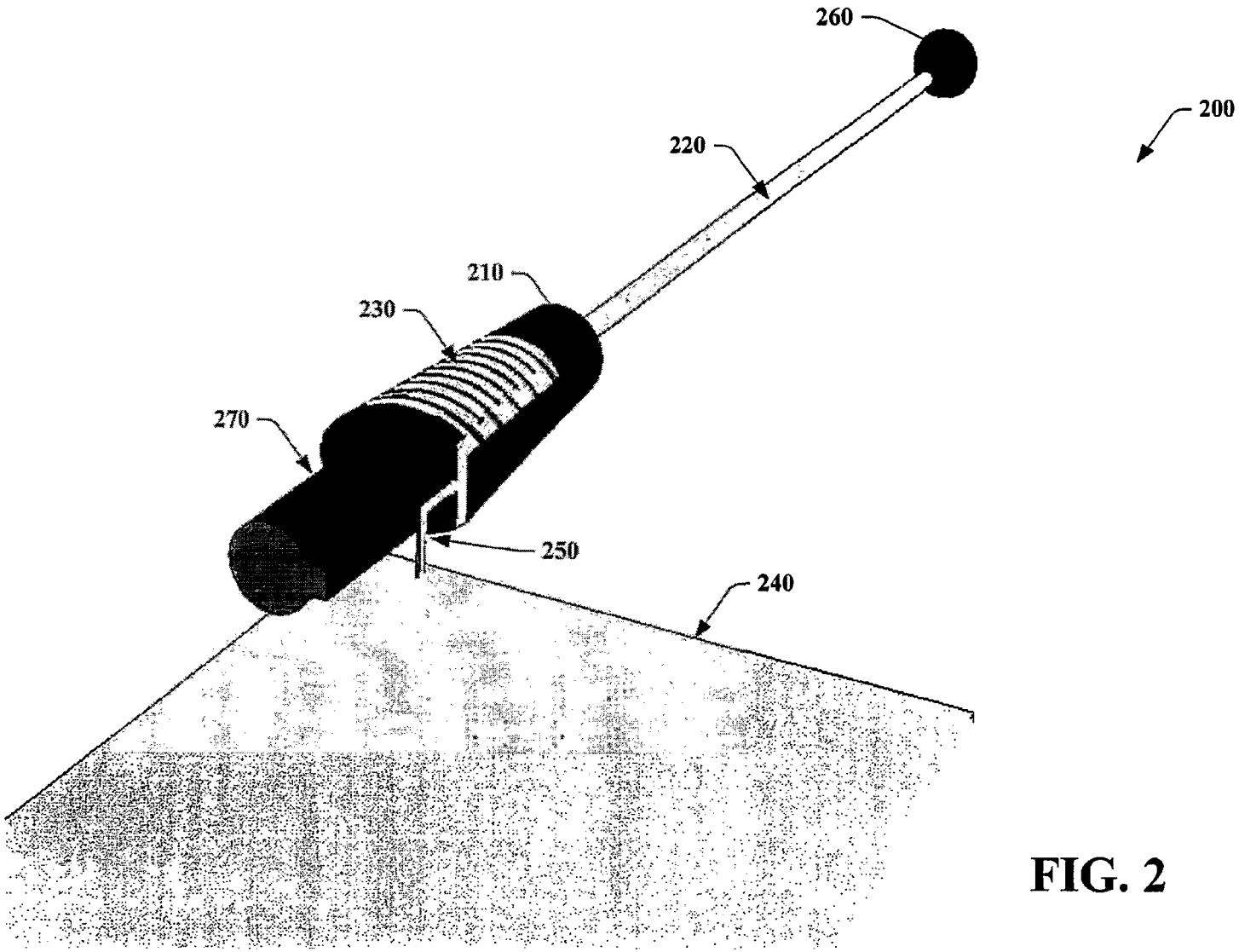
FIG. 2 is an exemplary antenna system that can be utilized in accordance with an aspect of the present invention.

FIG. 2 illustrates an exemplary three-dimensional perspective view of an antenna assembly in accordance with an aspect of the present invention, where a system 200 employs an active stub 210 (e.g., first antenna component 110) and a parasitic whip 220 (e.g., second antenna component 120). The parasitic whip 220 is extendable from the active stub 210, and is shown in extended position. The active stub 210, as illustrated, comprises a first meander line conductor 230 and a second meander line conductor (not shown), both formed along the length of the active stub 210. It is to be appreciated that the system can comprise any number of meander line conductors (e.g., meander line conductor 230) along the active stub 210. Each meander line conductor is tuned to transmit and receive electromagnetic signals within a predetermined range dependent upon the communication type (e.g., cellular communications, PCS, GPS, . . . ). Furthermore, the present invention contemplates other types of conductive components such as, for example, a helical conductor, etc.

According to one aspect of the present invention, the parasitic whip 220 can be aligned substantially parallel to and between the meander line conductors 230, and at least partially overlaps the active stub 210. There is no galvanic connection between the active stub 210 and the parasitic whip 220. The parasitic whip 220 can be tuned to operate at a particular frequency range based on the electrical length of the parasitic whip 220 and the amount of overlap between the parasitic whip and the active stub 210. Moreover, the parasitic whip 220 can overlap the active stub 210 by about 4 to 6 mm, for example. Additionally, according to another aspect of the present invention, for transmitting and/or receiving a dual-band signal with the active stub 210 tuned at 800 MHz/1900 MHz, the parasitic whip 220 is 60-120 mm long.

Furthermore, the parasitic whip 220 comprises a plastic extension 260 at the end of the whip. The plastic extension 260 is provided to prevent the parasitic whip 220 from completely entering into the active stub 210 when the whip is being retracted. Moreover, the plastic extension 260 can be utilized to detune the parasitic whip 220 from the active stub 210 when retracted as discussed in more detail below.

The meander line conductors (e.g., meander line conductor 230) are coupled to Printed Wiring Board (PWB) 240 via connector 250. The PWB 240 acts as a groundplane for the meander line conductor 230. Additionally, RF signals can be received by the meander line conductor 230 from circuitry (e.g., processing circuitry) positioned upon the PWB 240 and vice versa. The PWB 240 (e.g., a Printed Circuit Board, or PCB) typically comprises a non-conducting substrate (e.g., fiberglass with epoxy resin) upon which a conductive pattern is formed. The conductive pattern is typically constructed with copper, however it is to be appreciated that other conductive material such as nickel, silver, tin, tin-lead, gold and the like can be utilized, for example, concurrently as etchresists and/or top-level metal. In addition, the conductive pattern can be formed on multiple layers, and the layers can be connected with vias to reduce ohmic loss.

The PWB 240 can be a single or a double sided, or a multilayered board populated with passive and active circuitry via surface and/or wire mount and metal shield boxes. The components can include resistors, capacitors, inductors, solid states devices such as transistors and operational amplifiers, multi-layered components such as Application Specific Integrated Chips (ASICs) with analog, digital and/or RF layers, and the like. The PWB 240 can be manufactured to be rigid and/or flexible, and can be installed into devices such as wireless communications devices and/or mobile telephones.

By way of example, PWB 240 can comprise transmitting circuitry and receiving circuitry. The transmitting circuitry facilitates modulation of an information signal onto a carrier wave which has a carrier frequency associated with the type of communications being utilized (e.g., cellular, PCS, GPS, . . . ). The modulated signal is provided to the meander line conductor 230 via the connector 250 as a current. The current creates an electromagnetic field around the active stub 210 which varies according to the flow of current. The transmitted electromagnetic signal propagates towards the portion of the parasitic whip 220 that overlaps with the active stub 210, resulting in an induced current within the parasitic whip 220. The current traveling through the parasitic whip 220 then creates an electromagnetic field about the length of the parasitic whip 220 since the parasitic whip 220 resonates at frequencies close to the resonant frequencies of the active stub 210. Accordingly, and the parasitic whip 220 enhances the radiation of the active stub 210. Alternatively, it is to be appreciated that the active stub 210 and parasitic whip 220 can receive electromagnetic signals from, for example, a cellular communications base station, a wireless network access point, etc. Such signals can induce currents within the active stub 210 and the parasitic whip 220. The active stub 210 then can provide the electric signal to receiving circuitry located on the PWB 240 via the connector 250.

The active stub 210 further comprises a fastening component 270 which is operable to attach the active stub 210 to the housing of a wireless communications device. The fastening component 270, for example, can be keyed as show to prevent rotation of the active stub 210 within the housing. Furthermore, the fastening component 270 can provide an axial section that is removed (not shown) which enables the parasitic whip 220 to pass through that section when being retracted.

It is to be appreciated that the active stub 210 can comprise a helical active element instead of or in conjunction with the meander line conductor 230 in the system 200. Thus, when the parasitic whip 220 is extended, the parasitic whip 220 is positioned so that at least part of its length extends through the center of the helical coil.

Figure 3:
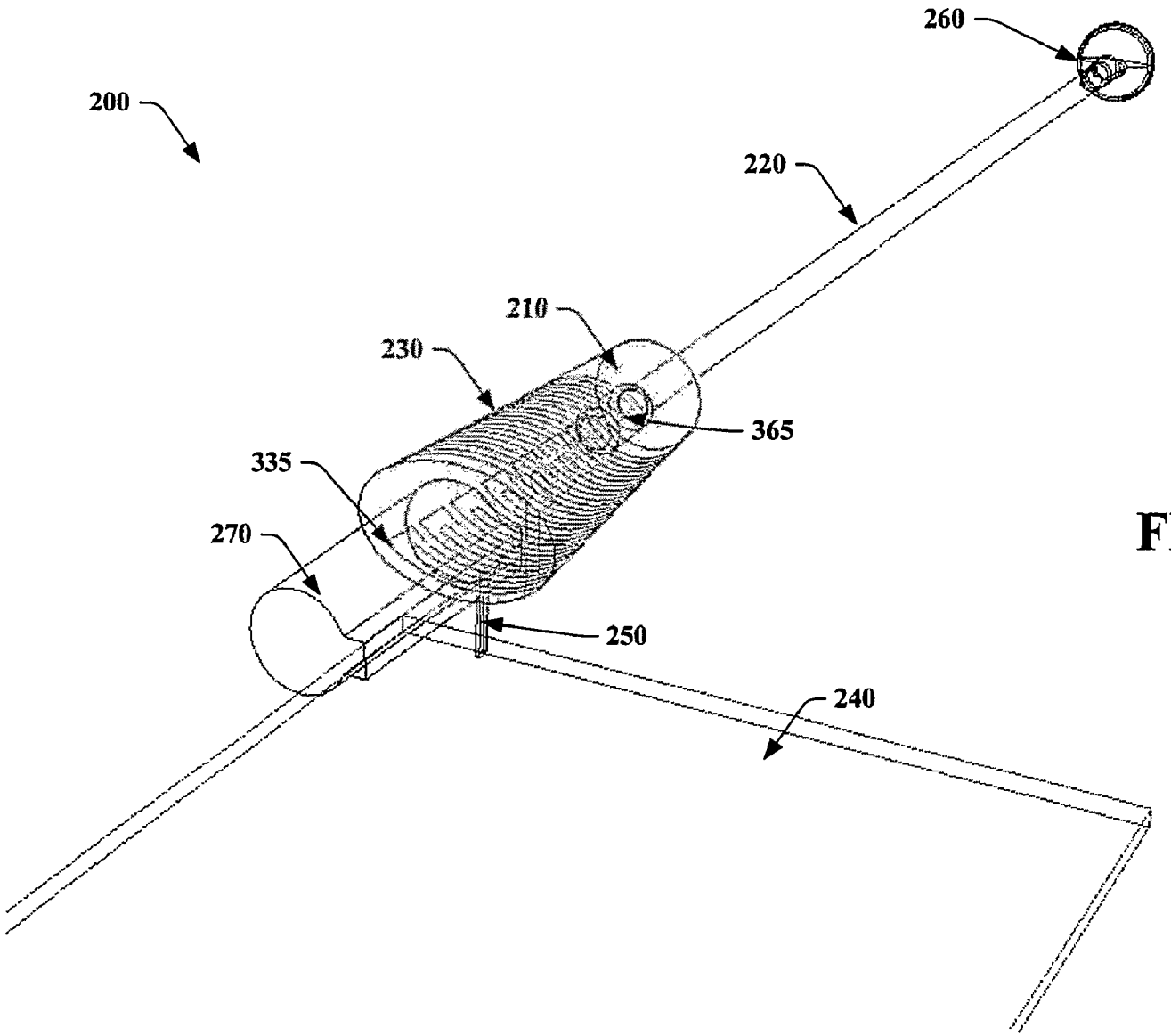
FIG. 3 is an exemplary antenna system that can be utilized in accordance with an aspect of the present invention.

FIG. 3 illustrates a three-dimensional perspective line drawing of the system 200 from FIG. 2. As depicted, the exemplary system 200 further comprises a second meander line conductor 335 associated with the active stub 210, which can operate at a second transmitting and/or receiving frequency that differs from that of the first meander line conductor 230. Additionally, the parasitic whip 220 comprises a stopper 365. The stopper 365 prevents the parasitic whip 220 from being completely withdrawn from between the meander line conductors 230, 335. For example, according to an aspect of the present invention, the stopper 365 can ensure that the parasitic whip 220 overlaps the active stub 210 by about 4-6 mm.

Figure 4:
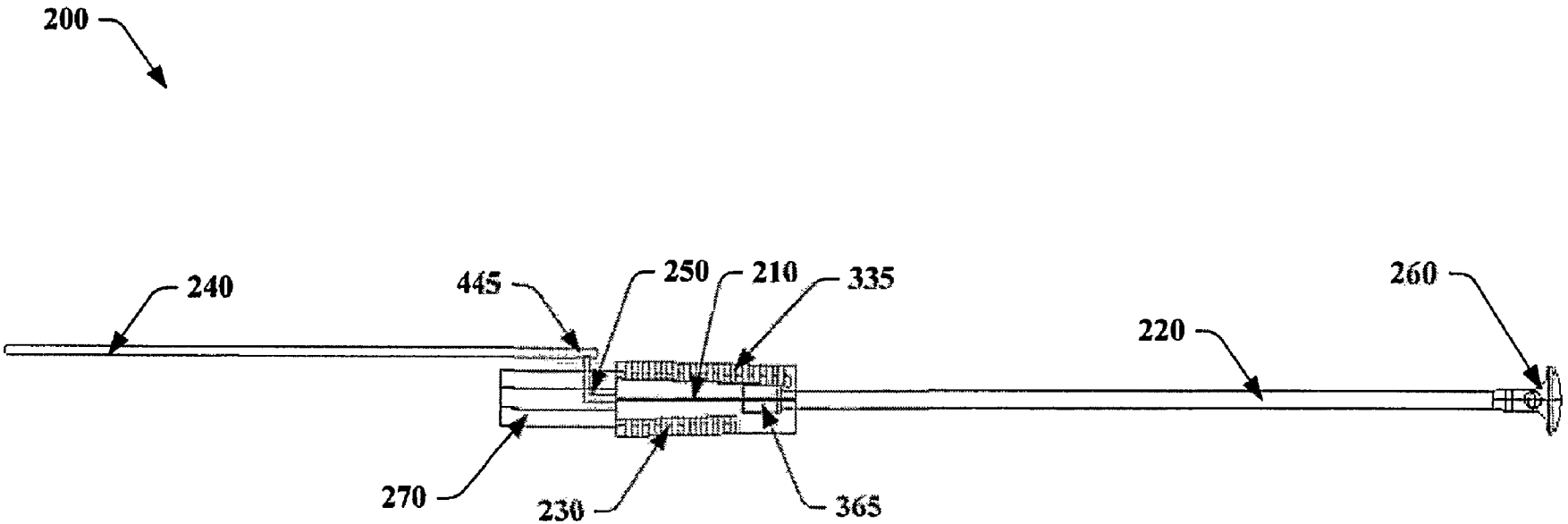
FIG. 4 is an exemplary antenna system that can be utilized in accordance with an aspect of the present invention.
Figure 5:
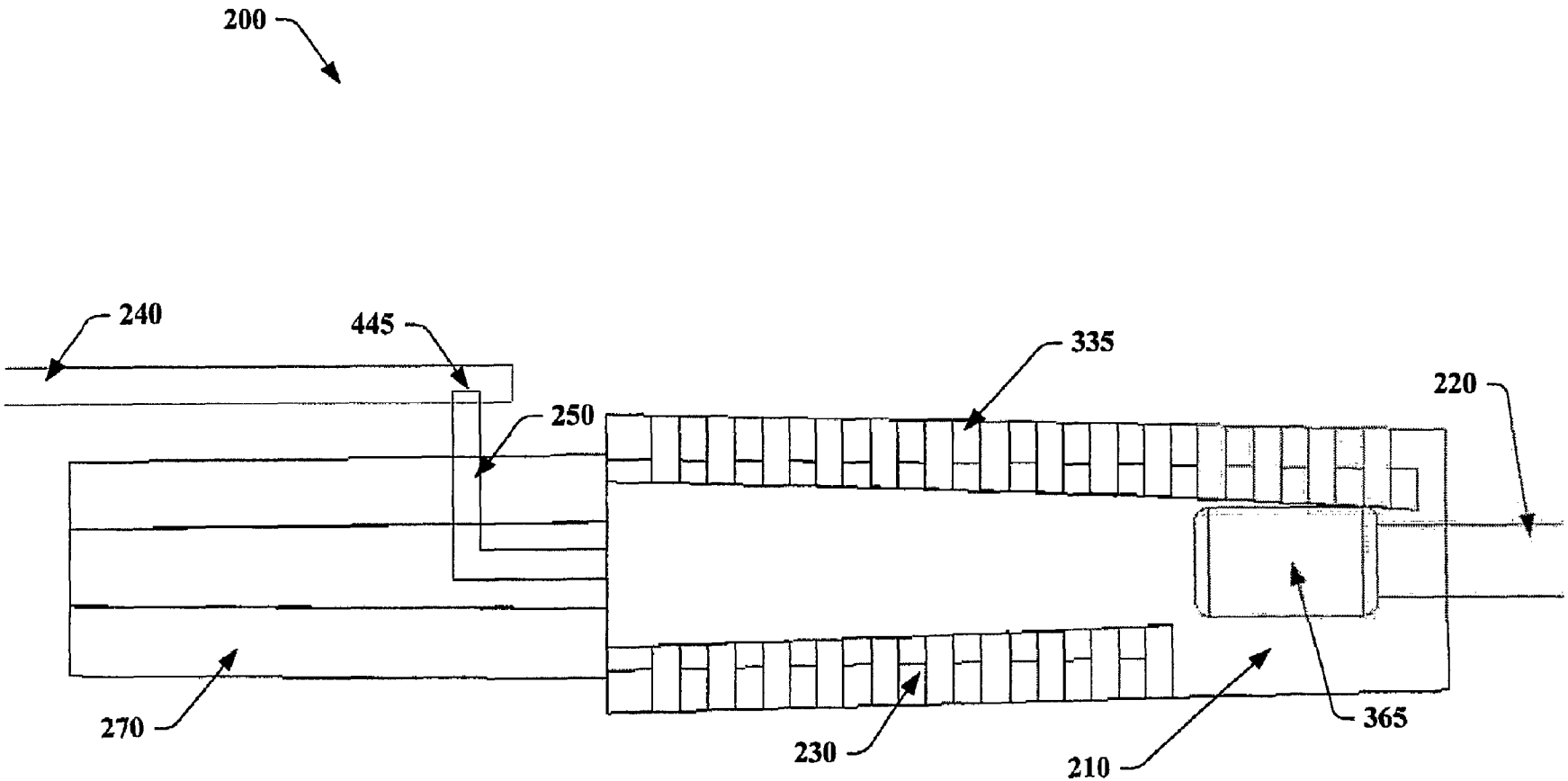
FIG. 5 is an exemplary antenna system that can be utilized in accordance with an aspect of the present invention.

Referring now to FIGS. 4 and 5, two-dimensional side views of the system 200 from FIG. 2 which comprises the active stub 210 and the parasitic whip 220 in extended position are illustrated. As depicted, the parasitic whip 220 is physically positioned between and substantially parallel to the two active meander line conductors 230, 335. A galvanic connection is provided between the PWB 240 and the meander line conductors 230, 335 via the connector 250. The connector 250 generally facilitates mounting the active stub 210 to the PWB 240. The mounting location 445 provides a means to fasten the active stub 210 to the PWB 240. For example, mounting components such as stand offs, screws, snaps, clips, solder joints, connectors, wires and the like can be employed in connection with the mounting location to selectively secure the active stub 210 to the PWB 240.

Figure 6:
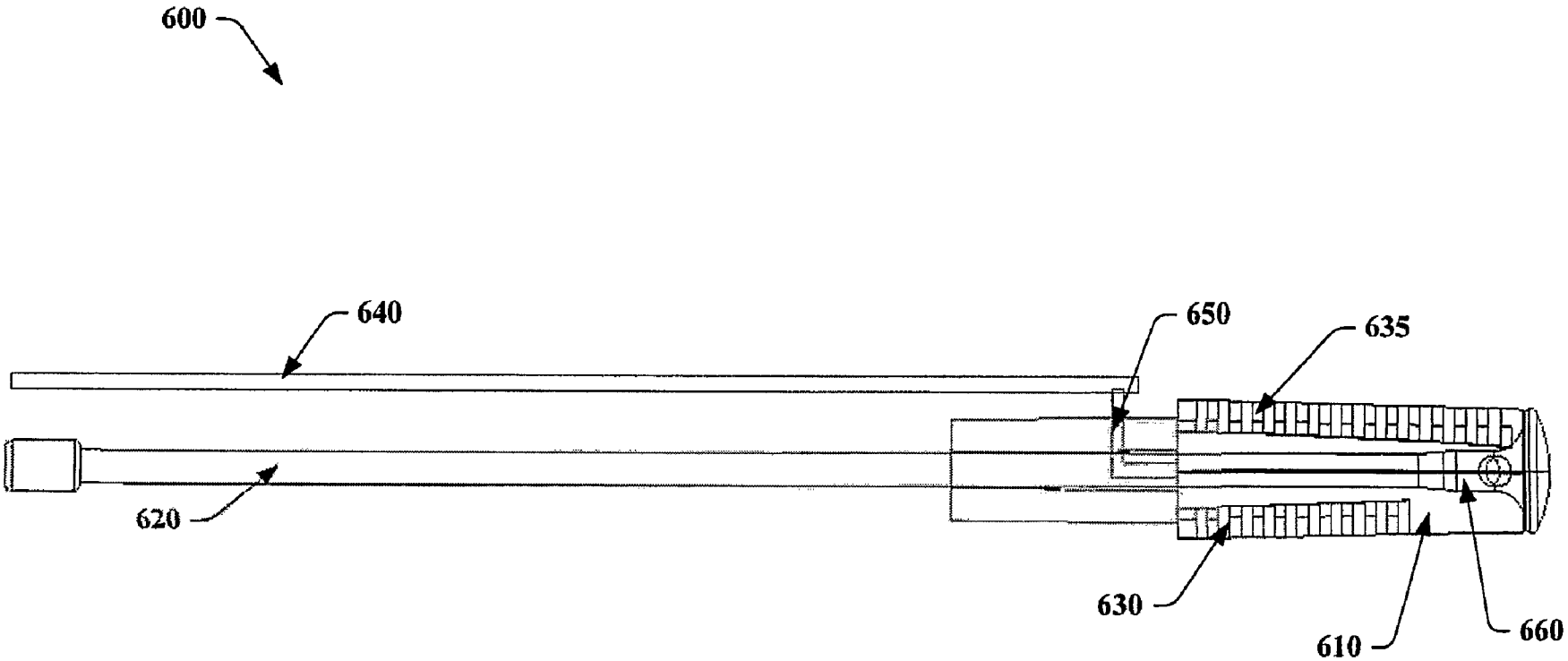
FIG. 6 is an exemplary antenna system that can be utilized in accordance with an aspect of the present invention.
Figure 7:
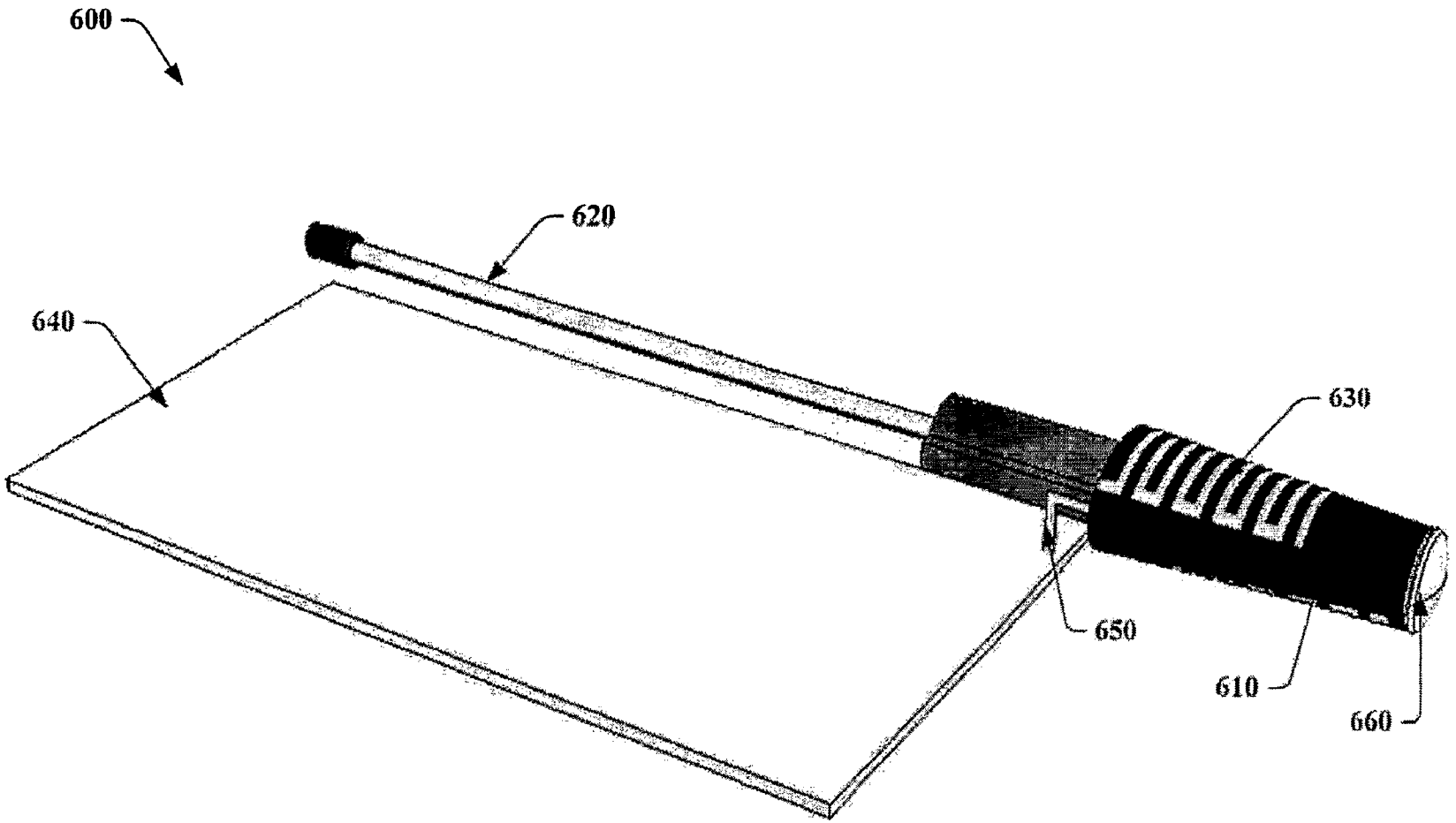
FIG. 7 is an exemplary antenna system that can be utilized in accordance with an aspect of the present invention.
Figure 8:
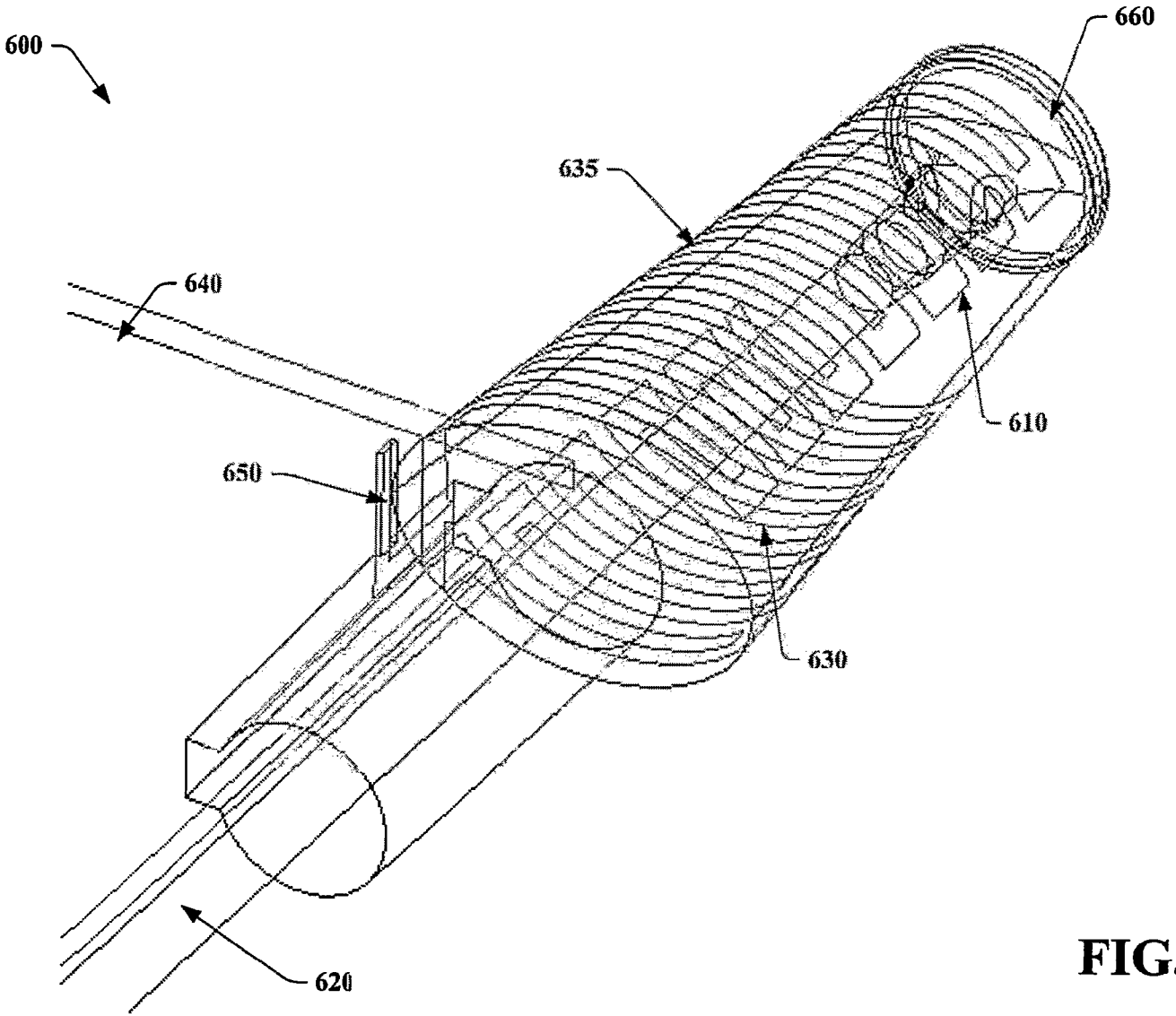
FIG. 8 is an exemplary antenna system that can be utilized in accordance with an aspect of the present invention.

FIGS. 6-8 illustrate an exemplary system 600 that includes an antenna assembly comprising an active stub 610 and a parasitic whip 620, which is a retracted position (e.g., retracted location). Turning to FIG. 6, a two-dimensional side view of the system 600 is illustrated. The system 600 comprises the active stub 610 and the parasitic whip 620. According to one aspect of the present invention, the active stub 610 comprises a first active meander element 630 and a second meander active element 635, which are tuned to operate at a particular frequency range associated with a communications type such as, for example, cellular communications, PCS, GPS, etc. The active meander elements 630, 635 are coupled to a PWB 640 via a connector 650. It is to be appreciated that the present invention contemplates utilizing any number of active elements. Furthermore, alternative active element designs such as, for example, a helical active element, can be employed in accordance with an aspect of the present invention.

The parasitic whip 620, as illustrated, is in retracted position. The parasitic whip 620 is shown to have been slid lengthwise through the active stub 610, and thus within the housing of a mobile communications device. Alternative parasitic whip 620 retraction designs are contemplated such as, for example but not limited to, a telescoping whip, a hinged whip, etc.

When in retracted position, the parasitic whip 620 is detuned (e.g., decoupled) from the active stub 610 so as to not impact the reception and/or transmission of a signal by the active stub 610. According to an aspect of the present invention, detuning can be accomplished utilizing a detuning circuit. By way of example, the detuning circuit can be physically located in any position that allows for the parasitic whip 620 to couple to the detuning circuit when the parasitic whip 620 being retracted. According to an aspect of the present invention, the detuning circuit can be located on the PWB 640 and can be coupled to the parasitic whip 620 via the connector 650. The detuning circuit can comprise a matching network which is designed based upon parameters such as the size of the PWB (e.g., groundplane), the length of the parasitic whip 620, the size of the active stub 610, etc.

Alternatively, detuning of the parasitic whip 620 can be accomplished by retracting the parasitic whip 620 far enough so that it does not overlap with the active stub 610. Such detuning (e.g., de-coupling) can be accomplished by employing a parasitic whip 620 that comprises a non-conductive end 660 (e.g., plastic).

Referring to FIG. 7, the system 600 from FIG. 6 is illustrated in a three-dimensional perspective view of the retracted parasitic whip 620 and the active stub 610. FIG. 8 depicts another three-dimensional perspective view of the system 600.

Figure 10:
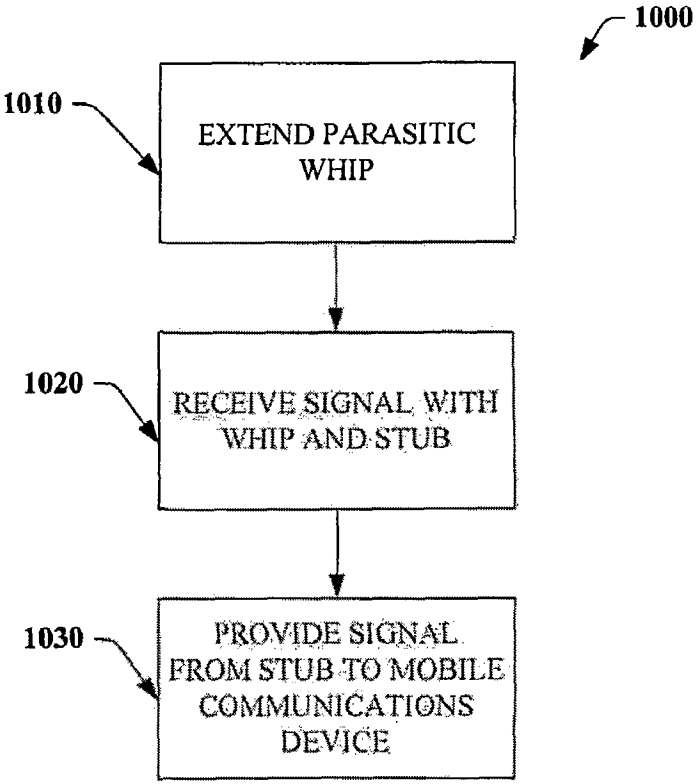
FIG. 10 is a flow diagram that illustrates a methodology that facilitates reception of a signal in accordance with an aspect of the present invention.
Figure 9:
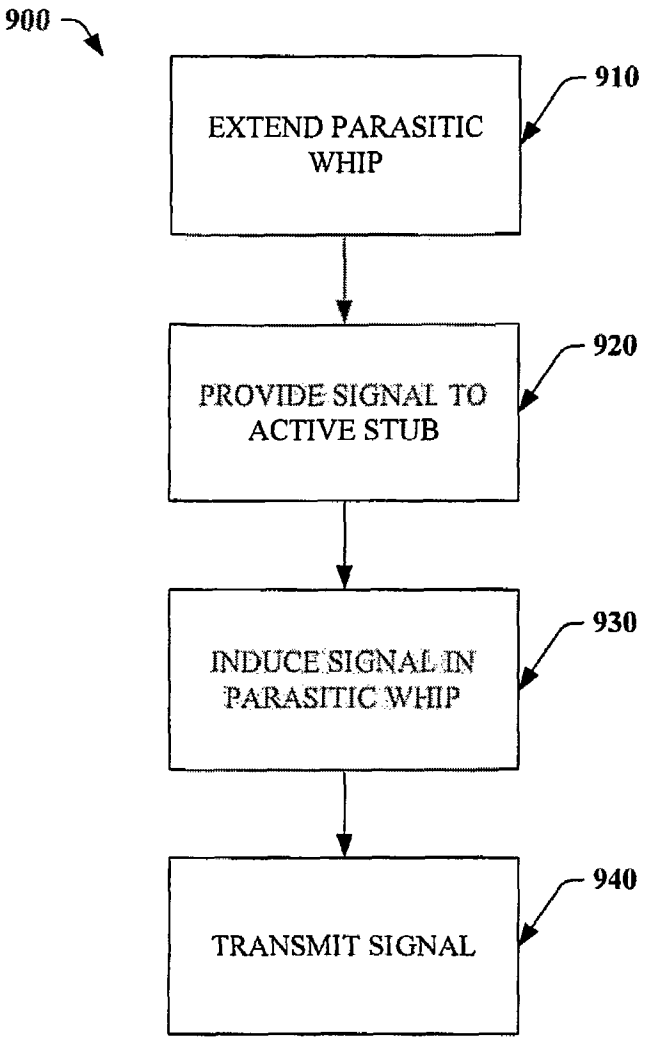
FIG. 9 is a flow diagram that illustrates a methodology that facilitates transmission of a signal in accordance with an aspect of the present invention.

FIGS. 9 and 10 illustrate methodologies, in accordance with an aspect the present invention. While, for purposes of simplicity of explanation, the methodologies are shown and described as a series of acts, it is to be understood and appreciated that the present invention is not limited by the order of acts, as some acts can, in accordance with the present invention, occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the present invention.

Now referring to FIG. 9, at 910 a parasitic whip is placed into an extended position with respect to an active stub. At 920, a signal (e.g., electrical signal) is provided to the active stub. The signal can be, for example, a radio frequency (RF) signal associated with one or more disparate communication types (e.g., cellular communications, PCS, GPS, . . . ). The active stub converts the electrical signal into an electromagnetic field. At 930, a current is induced in a parasitic whip. The current is induced from the electromagnetic field created by the active stub component. No galvanic connection exists between the active stub and the parasitic whip; thus, all current flow through the parasitic whip is a result of induction from the electromagnetic field. At 940, the signal is further transmitted by the parasitic whip and the active stub (e.g. transmitted to a cellular communications base station, wireless network access point, . . . ).

Turning now to FIG. 10, at 1010 a parasitic whip of an antenna structure is extended. By way of example, the parasitic whip can be extended to extend 60-120 mm beyond an active stub. At 1020, the active stub and parasitic whip receive an electromagnetic signal transmitted, which can be from, for example, a cellular communications base station, a wireless network, etc. The electromagnetic signal induces a current to flow within the antenna structure. At 1030, the received signal is provided to a mobile communications device such as, for example, a cellular phone, a PDA, a handheld computer, a notebook computer, a pager, etc.

Figure 11:
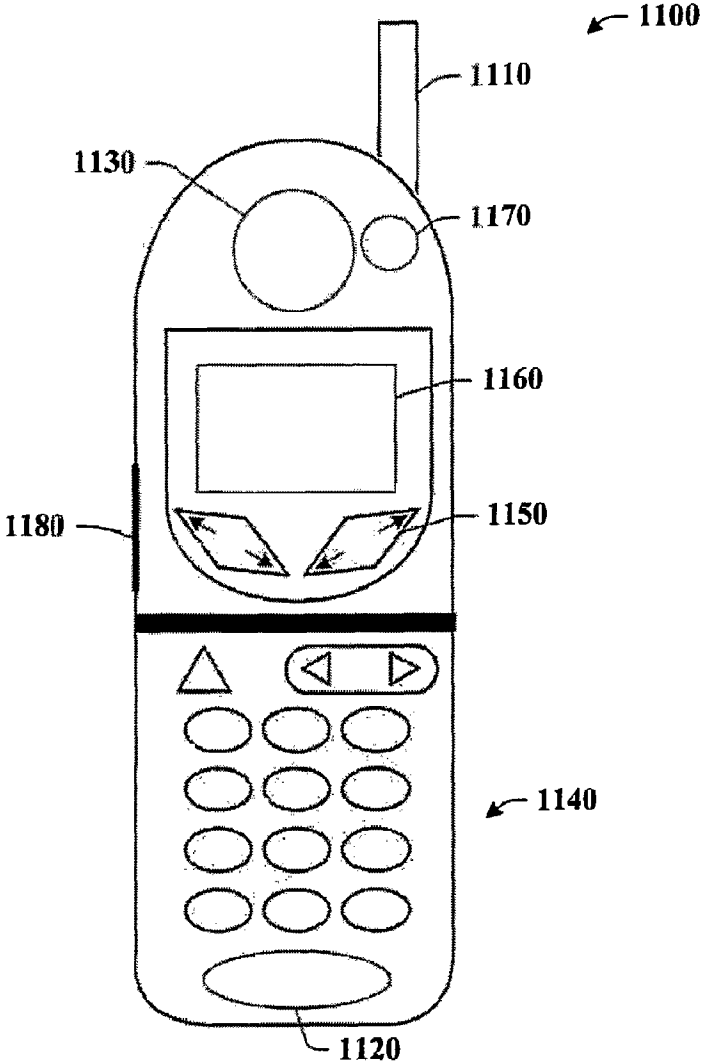
FIG. 11 illustrates an exemplary mobile device wherein the invention can be employed.

FIG. 11 illustrates an exemplary mobile (e.g., portable and wireless) telephone 1100 that can employ the novel aspects of the present invention. The mobile telephone 1100 comprises an antenna 1110 that communicates (e.g., transmit and receive) radio frequency signals with one or more base stations. The antenna 1110 comprises an active stub element and a parasitic whip element (e.g., as described herein) and can be coupled to duplexer circuitry within the mobile telephone 1100. In addition, the mobile telephone 1100 can include a separate signal-receiving component (not shown) that can also be coupled to the duplexer.

The mobile telephone 1100 further comprises a microphone 1120 that receives audio signals and conveys the signals to at least one on-board processor for audio signal processing, and an audio speaker 1130 for outputting audio signals to a user, including processed voice signals of a caller and recipient music, alarms, and notification tones or beeps. Additionally, the mobile telephone 1100 can include a power source such as a rechargeable battery (e.g., Alkaline, NiCAD, NiMH and Li-ion), which can provide power to substantially all onboard systems when the user is mobile.

The mobile telephone 1100 can further include a plurality of multi-function buttons including a keypad 1140, menu navigating buttons 1150 and on-screen touch sensitive locations (not shown) to allow a user to provide information for dialing numbers, selecting options, navigating the Internet, enabling/disabling power, and navigating a software menu system including features in accordance with telephone configurations. A display 1160 can be provided for displaying information to the user such as a dialed telephone number, caller telephone number (e.g., caller ID), notification information, web pages, electronic mail, and files such as documents, spreadsheets and videos. The display 1160 can be a color or monochrome display (e.g., liquid crystal, CRT, LCD, LED and/or flat panel), and employed concurrently with audio information such as beeps, notifications and voice. Where the mobile telephone 1100 is suitable for Internet communications, web page and electronic mail (e-mail) information can also be presented separately or in combination with the audio signals.

The menu navigating buttons 1150 can further enable the user to interact with the display information. In support of such capabilities, the keypad 1140 can provide keys that facilitate alphanumeric input, and are multifunctional such that the user can respond by inputting alphanumeric and special characters via the keypad 1140 in accordance with e-mail or other forms of messaging communications. The keypad keys also allow the user to control at least other telephone features such as audio volume and display brightness.

An interface can be utilized for uploading and downloading information to memory, for example, the reacquisition time data to the telephone table memory, and other information of the telephone second memory (e.g., website information and content, caller history information, address book and telephone numbers, and music residing in the second memory). A power button 1170 allows the user to turn the mobile telephone 1100 power on or off.

The mobile telephone 1100 can further include memory for storing information. The memory can include non-volatile memory and volatile memory, and can be permanent and/or removable. The mobile telephone 1100 can further include a high-speed data interface 1180 such as USB (Universal Serial Bus) and IEEE 1394 for communicating data with a computer. Such interfaces can be used for uploading and downloading information, for example website information and content, caller history information, address book and telephone numbers, and music residing in the second memory. In addition, the mobile telephone 1100 can communicate with various input/output (I/O) devices such as a keyboard, a keypad, and a mouse.

Figure 12:
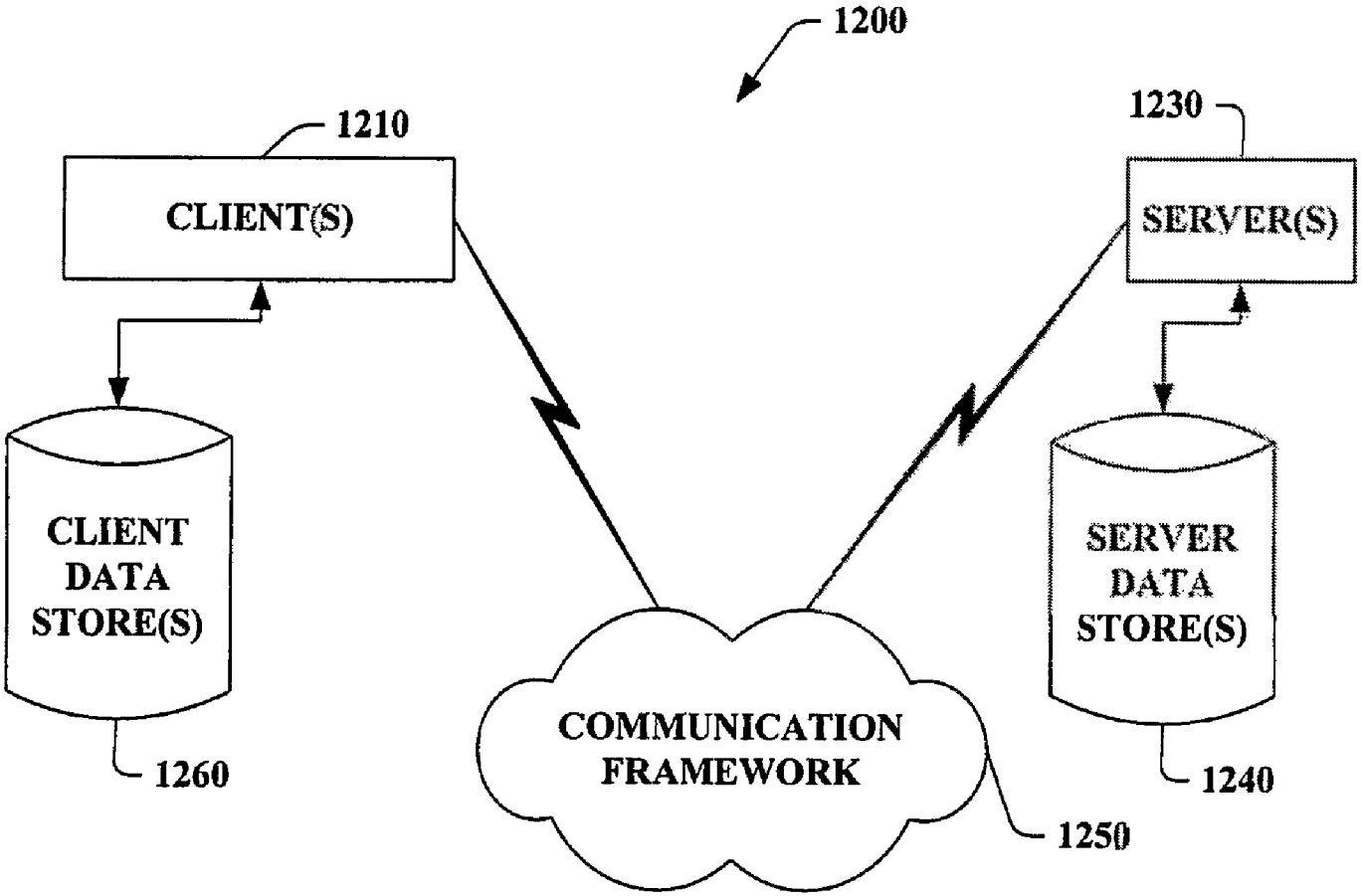
FIG. 12 illustrates an exemplary network wherein the invention can be employed.
Figure 13:
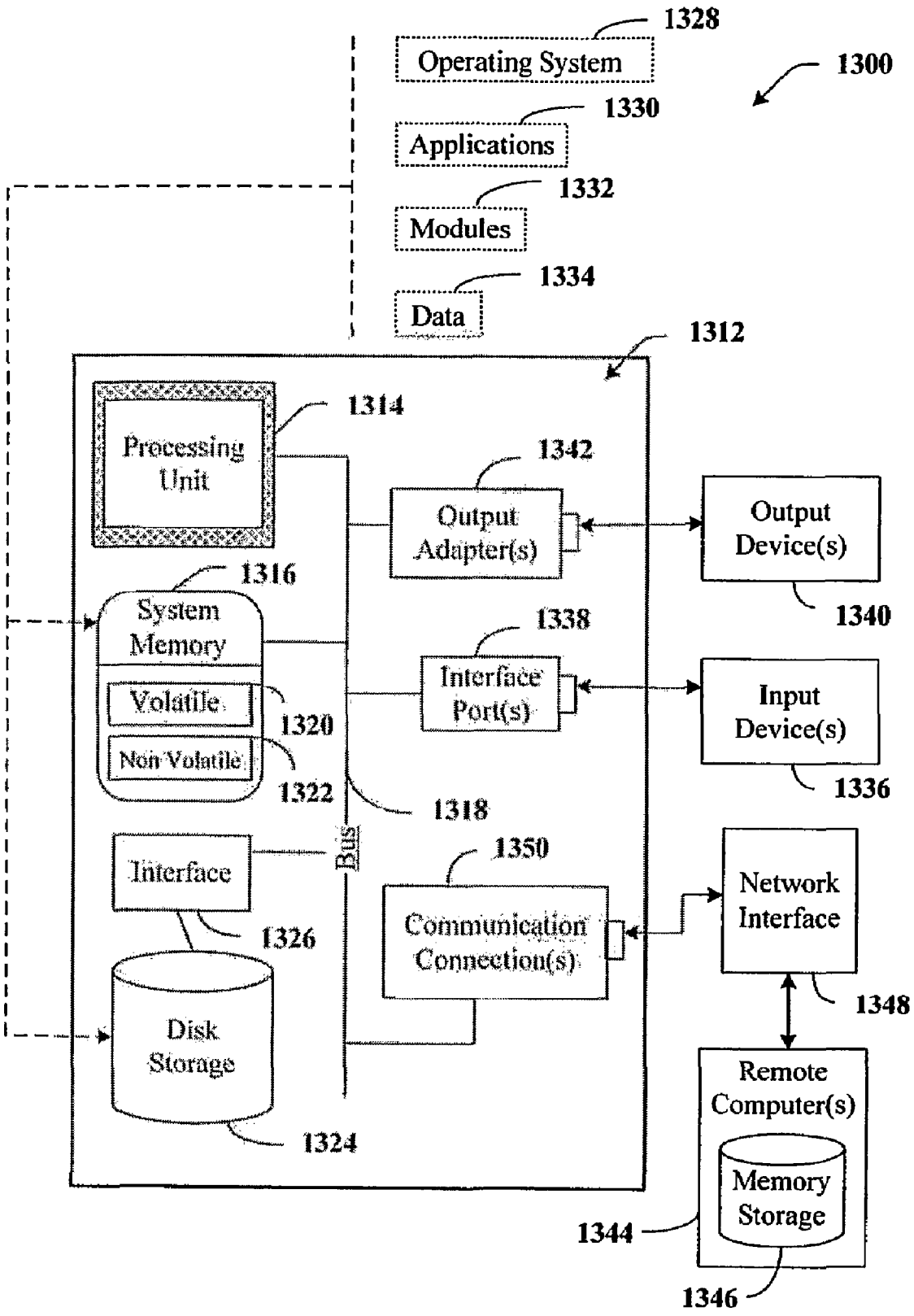
FIG. 13 illustrates an exemplary computing environment wherein the invention can be employed.

In order to provide a context for the various aspects of the invention, FIGS. 12 and 13 as well as the following discussion are intended to provide a brief, general description of a suitable computing environment in which the various aspects of the present invention can be implemented. While the invention has been described above in the general context of computer-executable instructions of a computer program that runs on a computer and/or computers, those skilled in the art will recognize that the invention also can be implemented in combination with other program modules. Generally, program modules include routines, programs, components, data structures, etc. that perform particular tasks and/or implement particular abstract data types.

Moreover, those skilled in the art will appreciate that the inventive methods may be practiced with other computer system configurations, including single-processor or multiprocessor computer systems, mini-computing devices, mainframe computers, as well as personal computers, hand-held computing devices, microprocessor-based or programmable consumer electronics, and the like. The illustrated aspects of the invention may also be practiced in distributed computing environments where task are performed by remote processing devices that are linked through a communications network.

However, some, if not all aspects of the invention can be practiced on stand-alone computers. In a distributed computing environment, program modules may be located in both local and remote memory storage devices.

FIG. 12 illustrates an exemplary computing environment 1200 in which the present invention can be employed. The system 1200 includes one or more client(s) 1210. The client(s) 1210 can be hardware and/or software (e.g., threads, processes, computing devices). The system 1200 additionally includes one or more server(s) 1230. Likewise, the server(s) 1230 can be hardware and/or software (e.g., threads, processes, computing devices).

One possible communication between a client 1210 and a server 1230 can be in the form of a data packet transmitted between two or more computer processes. The system 1200 further includes a communication framework 1250 that can be employed to facilitate communications between the client(s) 1210 and the server(s) 1230. The client(s) 1210 can interface with one or more client data store(s) 1260, which can be employed to store information local to the client(s) 1210. Similarly, the server(s) 1200 can interface with one or more server data store(s) 1240, which can be employed to store information local to the servers 1230.

With reference to FIG. 13, an exemplary environment 1310 for implementing various aspects of the invention includes a computer 1312. The computer 1312 includes a processing unit 1314, a system memory 1316, and a system bus 1318. The system bus 1318 couples system components including, but not limited to, the system memory 1316 to the processing unit 1314. The processing unit 1314 can be any of various available processors. Dual microprocessors and other multiprocessor architectures also can be employed as the processing unit 1314.

The system bus 1318 can be any of several types of bus structure(s) including the memory bus or memory controller, a peripheral bus or external bus, and/or a local bus using any variety of available bus architectures including, but not limited to, 8-bit bus, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI).

The system memory 1316 includes volatile memory 1320 and nonvolatile memory 1322. The basic input/output system (BIOS), containing the basic routines to transfer information between elements within the computer 1312, such as during start-up, is stored in nonvolatile memory 1322. By way of illustration, and not limitation, nonvolatile memory 1322 can include read only memory (ROM), programmable ROM (PROM), electrically programmable ROM (EPROM), electrically erasable ROM (EEPROM), or flash memory. Volatile memory 1320 includes random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM).

Computer 1312 also includes removable/non-removable, volatile/non-volatile computer storage media. FIG. 13 illustrates, for example a disk storage 1324. Disk storage 1324 includes, but is not limited to, devices like a magnetic disk drive, floppy disk drive, tape drive, Jaz drive, Zip drive, LS-100 drive, flash memory card, or memory stick. In addition, disk storage 1324 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 1324 to the system bus 1318, a removable or non-removable interface is typically used such as interface 1326.

It is to be appreciated that FIG. 13 describes software that acts as an intermediary between users and the basic computer resources described in suitable operating environment 1310. Such software includes an operating system 1328. Operating system 1328, which can be stored on disk storage 1324, acts to control and allocate resources of the computer system 1312. System applications 1330 take advantage of the management of resources by operating system 1328 through program modules 1332 and program data 1334 stored either in system memory 1316 or on disk storage 1324. It is to be appreciated that the present invention can be implemented with various operating systems or combinations of operating systems.

A user enters commands or information into the computer 1312 through input device(s) 1336. Input devices 1336 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1414 through the system bus 1318 via interface port(s) 1338. Interface port(s) 1338 include, for example, a serial port, a parallel port, a game port, and a universal serial bus (USB). Output device(s) 1340 use some of the same type of ports as input device(s) 1336. Thus, for example, a USB port may be used to provide input to computer 1312, and to output information from computer 1312 to an output device 1340. Output adapter 1342 is provided to illustrate that there are some output devices 1340 like monitors, speakers, and printers, among other output devices 1340, which require special adapters. The output adapters 1342 include, by way of illustration and not limitation, video and sound cards that provide a means of connection between the output device 1340 and the system bus 1318. It should be noted that other devices and/or systems of devices provide both input and output capabilities such as remote computer(s) 1344.

Computer 1312 can operate in a networked environment using logical connections to one or more remote computers, such as remote computer(s) 1344. The remote computer(s) 1344 can be a personal computer, a server, a router, a network PC, a workstation, a microprocessor based appliance, a peer device or other common network node and the like, and typically includes many or all of the elements described relative to computer 1312. For purposes of brevity, only a memory storage device 1346 is illustrated with remote computer(s) 1344. Remote computer(s) 1344 is logically connected to computer 1312 through a network interface 1348 and then physically connected via communication connection 1350. Network interface 1348 encompasses communication networks such as local-area networks (LAN) and wide-area networks (WAN). LAN technologies include Fiber Distributed Data Interface (FDDI), Copper Distributed Data Interface (CDDI), Ethernet/IEEE 802.3, Token Ring/IEEE 802.5 and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 1350 refers to the hardware/software employed to connect the network interface 1348 to the bus 1318. While communication connection 1350 is shown for illustrative clarity inside computer 1312, it can also be external to computer 1312. The hardware/software necessary for connection to the network interface 1348 includes, for exemplary purposes only, internal and external technologies such as, modems including regular telephone grade modems, cable modems and DSL modems, ISDN adapters, and Ethernet cards.

What has been described above includes examples of the present invention. It is, of course, not possible to describe every conceivable combination of components or methodologies for purposes of describing the present invention, but one of ordinary skill in the art may recognize that many further combinations and permutations of the present invention are possible. Accordingly, the present invention is intended to embrace all such alterations, modifications, and variations that fall within the spirit and scope of the appended claims.

What is claimed is:

1. An apparatus comprising:

a transceiving antenna component that is coupled to a first wireless communication device, the transceiving antenna component configured to receive a modulated signal from the first wireless communication device; and an extendable antenna component that is coupled to the transceiving antenna component via a nongalvanic interface, the transceiving antenna component configured to convey the modulated signal to the extendable antenna component via electromagnetic induction, the extendable antenna component configured to widen a bandwidth of the transceiving antenna component for transmitting the signal to at least one other wireless communication device.

2. The apparatus of claim 1, wherein the transceiving antenna component comprises an active stub.

3. The apparatus of claim 2, wherein the active stub comprises at least two active elements, respective active elements each associated with disparate resonant frequencies.

4. The apparatus of claim 2, wherein the transceiving antenna element comprises at least one of a meander line conductor and a helical conductor.

5. The apparatus of claim 1, wherein the extendable antenna component is a parasitic whip.

6. The apparatus of claim 1, wherein the extendable antenna component resonates at 800 MHz and 1900 MHz when the extendable antenna component is about 60-120 mm in length and overlaps the transceiving antenna component by about 4-6 mm.

7. The apparatus of claim 1, wherein the extendable antenna component is detuned via positioning the extendable antenna component in a retracted location relative to the transceiving antenna component.

8. The apparatus of claim 7, wherein the extendable antenna component is detuned by at least one of a matching network and de-coupling the extendable component and the transceiving antenna component via a non-conductive end of the extendable antenna component.

9. The apparatus of claim 1 disposed within one of a cellular phone, a PDA, a handheld computer, a notebook computer, and a pager.

10. The apparatus of claim 1, wherein the extendable antenna component further receives a signal from at least one other wireless communication device, the signal is inductively transferred to the transceiving antenna component, which conveys the signal to the first wireless communication device.

11. An apparatus comprising:

a transceiving antenna component configured to receive a modulated signal; and an extendable antenna component that is coupled to the transceiving antenna component via a nongalvanic interface, the transceiving antenna component configured to convey the modulated signal to the extendable antenna component via electromagnetic induction, the extendable antenna component configured to transmit the signal, and wherein the extendable antenna component is tuned to operate at a frequency based on a length of the extendable antenna component and an amount of overlap between the transceiving antenna component and the extendable antenna component.

12. An apparatus comprising:

an active stub tuned to resonate at multiple frequency bands; and a parasitic whip coupled to the active stub, the parasitic whip configured to widen a bandwidth of a received signal resonating at least partially within one of the tuned frequency bands of the active stub and for inductively transferring the signal to the active stub.

13. The apparatus of claim 12, wherein the active stub comprises at least two meander line conductors and the parasitic whip is aligned substantially parallel to and between the meander line conductors.

14. The apparatus of claim 12, wherein the active stub comprises a helical conductor, and the parasitic whip is aligned through approximately the center of the helical conductor.

15. The apparatus of claim 12 disposed within one of a cellular phone, a PDA, a handheld computer, a notebook computer, and a pager.

16. The apparatus of claim 12, wherein the parasitic whip is tuned to the frequency based on an amount of overlap with the active stub and a size of the parasitic whip.

17. The apparatus of claim 12, wherein the parasitic whip is tuned to receive signals within the 800 MHz and 1900 MHz band when a length of the parasitic whip is about 60-120 mm and an overlap with the active stub is about 4-6 mm.

18. The apparatus of claim 12, wherein the parasitic whip is detuned via retracting the parasitic whip relative to the active stub.

19. The apparatus of claim 12, wherein the parasitic whip further inductively receives a signal from the active stub and transmits the signal.

20. A method comprising:

extending a parasitic whip to overlap an active stub;

providing the active stub with a radio frequency signal from a wireless communications device;

inducing a current in the parasitic whip; and transmitting the signal utilizing both the active stub and the parasitic whip such that the parasitic whip widens a bandwidth of the active stub.

21. The method of claim 20 further comprising detuning the parasitic whip by retracting the parasitic whip.

22. The method of claim 21, further comprising transmitting another signal via the active stub when the parasitic whip is detuned.

23. An apparatus comprising:

a fixed antenna component; and an extendable antenna component inductively coupled to the fixed antenna component in an extended position via an overlap extending at least about 4 mm between the fixed and extendable antenna components, and decoupled from the fixed antenna component in a retracted position;

wherein the extendable antenna component operates in the extended position to widen a bandwidth of the fixed antenna element.

24. The apparatus of claim 23, wherein the overlap extends between about 4-6 mm.

25. The apparatus of claim 23, wherein the extendable antenna component is decoupled from the fixed antenna component by a detuning circuit.

26. The apparatus of claim 23, further comprising a printed wiring board comprising transceiver circuitry coupled to the fixed antenna component, said extendable antenna coupled to the transceiver circuitry only through the fixed antenna component and only when said extendable antenna component is in the extended position.

27. The apparatus of claim 23, wherein the extendable antenna component comprises one of a quarter wavelength whip, a three-eighths wavelength whip, and a five-eighths wavelength whip.

28. The apparatus of claim 23, disposed within a mobile device, said mobile device further comprising a display and a keypad.

29. An apparatus comprising:

a fixed antenna component; and an extendable antenna component inductively coupled to the fixed antenna component in an extended position via an overlap extending at least about 4 mm between the fixed and extendable antenna components, and decoupled from the fixed antenna component in a retracted position by a detuning circuit that is disposed on a printed wiring board that comprises a ground plane to the fixed antenna component.

30. An apparatus comprising:

a fixed antenna component; and an extendable antenna component inductively coupled to the fixed antenna component in an extended position via an overlap extending at least about 4 mm between the fixed and extendable antenna components, and decoupled from the fixed antenna component in a retracted position by a non-conductive portion of the extendable antenna component overlapping with the fixed antenna component while in the retracted position.

31. An apparatus comprising:

a fixed antenna component; and an extendable antenna component inductively coupled to the fixed antenna component in an extended position via an overlap extending at least about 4 mm between the fixed and extendable antenna components, and decoupled from the fixed antenna component in a retracted position;

wherein the fixed antenna component is coupled to a printed wiring board that comprises a ground plane to the fixed antenna component, said extendable antenna component disposed so as to lie alongside the printed wiring board while in the retracted position.

* * * * *

UNITED STATES PATENT AND TRADEMARK OFFICE

CERTIFICATE OF CORRECTION

PATENT NO. : 7,495,619 B2
APPLICATION NO. : 10/588670
DATED : February 24, 2009
INVENTOR(S) : Fossett It is certified that error appears in the above-identified patent and that said Letters Patent is hereby corrected as shown below:

Claim 10, column 13, lines 63-64, after "signal", please delete "from at least one other wireless communication device".

Signed and Sealed this

Twenty-eighth Day of April, 2009

JOHN DOLL
*Acting Director of the United States Patent and Trademark Office*